US007981005B1

(12) United States Patent
Tsai

(10) Patent No.: US 7,981,005 B1
(45) Date of Patent: Jul. 19, 2011

(54) LEG EXERCISER WITH OPPOSITE WHEELED SWIVEL FOOT PLATES ON FOLDING SWIVEL RAILS

(75) Inventor: Jao-Hsing Tsai, Hsinchu (TW)

(73) Assignee: Cheng-Kang Chu, Hsinchu (TW)

( * ) Notice: Subject to any disclaimer, the term of this patent is extended or adjusted under 35 U.S.C. 154(b) by 0 days.

(21) Appl. No.: 12/949,234

(22) Filed: Nov. 18, 2010

(51) Int. Cl.
*A63B 22/14* (2006.01)
*A63B 22/00* (2006.01)

(52) U.S. Cl. ..... 482/51; 482/147; 482/70

(58) Field of Classification Search ..... 482/51, 482/52, 70, 79–80, 121, 132, 135, 129, 130, 482/146–147, 907
See application file for complete search history.

(56) References Cited

U.S. PATENT DOCUMENTS 4,781,372 A * 11/1988 McCormack ..... 482/70
5,279,532 A * 1/1994 Chen ..... 482/71
5,328,427 A * 7/1994 Sleamaker ..... 482/71
6,042,523 A * 3/2000 Graham ..... 482/121
6,368,254 B1 * 4/2002 Wall ..... 482/71
D512,111 S * 11/2005 Summers ..... D21/668
7,125,367 B1 * 10/2006 Stearns ..... 482/141
D550,312 S * 9/2007 Summers ..... D21/668
7,294,100 B2 * 11/2007 Bull ..... 482/51
7,303,511 B2 * 12/2007 Bull ..... 482/71
7,438,673 B1 * 10/2008 Jones ..... 482/71
D589,573 S * 3/2009 McVay et al. ..... D21/668
7,530,928 B2 * 5/2009 Liao ..... 482/53
7,641,603 B2 * 1/2010 Lacher ..... 482/134
7,645,218 B2 * 1/2010 Potok ..... 482/141
D620,540 S * 7/2010 McVay et al. ..... D21/668
7,780,585 B1 * 8/2010 Rivas ..... 482/140
7,798,943 B1 * 9/2010 Tsai ..... 482/70
7,892,152 B1 * 2/2011 Teng ..... 482/79

* cited by examiner

*Primary Examiner* — Steve R Crow

(57) ABSTRACT

An exerciser includes a base comprising a rotatable central seat and a fixed support upwardly extending out of the seat; first and second carriage assemblies each comprising two opposite rails each having one end formed as a joint pivotably secured to either side of the seat, a bar across the other ends of the rails, and a foot plate adapted to rotate horizontally with respect to the rails and move along the rails; and first and second damping assembly in the first and second carriage assemblies respectively and each comprising two rollers fixedly secured to the seat between the joints and an intermediate portion of the bar respectively, an elastic belt passing the rollers, and two attachments at both ends of the first elastic belt respectively, the attachments being releasably fastened at either carriage assembly.

5 Claims, 6 Drawing Sheets

LEG EXERCISER WITH OPPOSITE WHEELED SWIVEL FOOT PLATES ON FOLDING SWIVEL RAILS

BACKGROUND OF THE INVENTION

1. Field of Invention

The invention relates to leg exercise devices and more particularly to a leg exerciser having two opposite swivel foot plates each adapted to wheel on two parallel rails of a folding carriage assembly which is biased by an elastic damping assembly so as to exercise inner and outer muscles of legs and stretch legs, exercise the feet, and exercise the lumbar zones.

2. Description of Related Art

There is a great array of exercise equipment for exercising different parts of the human body commercially available. For exercising legs, there are exercise treadmills, stationary exercise bicycles, continuous passive motion leg exercisers, etc. However, exercisers for both exercising inner and outer muscles of legs and stretching legs are not disclosed in any documents as far as the present invention is aware.

There is a conventional type of exerciser for stretching legs. The exerciser comprises two foot plates pivotably mounted on two rollers so that rotation of the foot plates can rotate about the rollers when performing an exercise of legs.

The conventional type of exerciser has the benefit of, in addition to leg stretching, exercising inner and outer muscles of legs or rotating feet. However, its construction is complicated and prone to malfunction in use. Further, it lacks means for exercising other body parts. Thus, the need for improvement still exists.

SUMMARY OF THE INVENTION

It is therefore one object of the invention to provide an exercise device comprising a base comprising a rotatable central seat and a fixed support upwardly extending out of the seat wherein the seat is adapted to rotate about the support; first and second carriage assemblies each comprising two opposite rails each having one end formed as a joint pivotably secured to either side of the seat so that each of the first and second carriage assemblies is adapted to either pivot upward about the seat to dispose in a folded position or pivot downward about the seat to dispose in a horizontal ready to use position, a bar disposed across the other ends of the rails, and a foot plate adapted to rotate horizontally with respect to the rails and move along the rails; first damping assembly disposed in the first carriage assembly and comprising two first rollers wherein one first roller is fixedly secured to the seat between the joints of the first carriage assembly and the other first roller is fixedly secured to an intermediate portion of the bar of the first carriage assembly respectively, a first elastic belt passing the first rollers, and two first attachments formed at both ends of the first elastic belt respectively, the first attachments being releasably fastened at the first carriage assembly; and second damping assembly disposed in the second carriage assembly and comprising two second rollers fixedly secured to the seat between the joints of the second carriage assembly and an intermediate portion of the bar of the second carriage assembly respectively, a second elastic belt passing the first rollers, and two second attachments formed at both ends of the second elastic belt respectively, the second attachments being releasably fastened at the second carriage assembly, wherein in a first configuration one first attachment is stopped by one first roller on the bar of the first carriage assembly, the other first attachment is releasably secured to the foot plate of the first carriage assembly, one second attachment is stopped by one second roller on the bar of the second carriage assembly, and the other second attachment is releasably secured to the foot plate of the second carriage assembly; and wherein in a second configuration one first attachment is releasably secured to the foot plate of the first carriage assembly, the other first attachment is stopped by the other first roller on the seat, one second attachment is releasably secured to the foot plate of the second carriage assembly, and the other second attachment is stopped by the other second roller on the seat.

The above and other objects, features and advantages of the invention will become apparent from the following detailed description taken with the accompanying drawings.

DETAILED DESCRIPTION OF THE INVENTION

Figure 1:
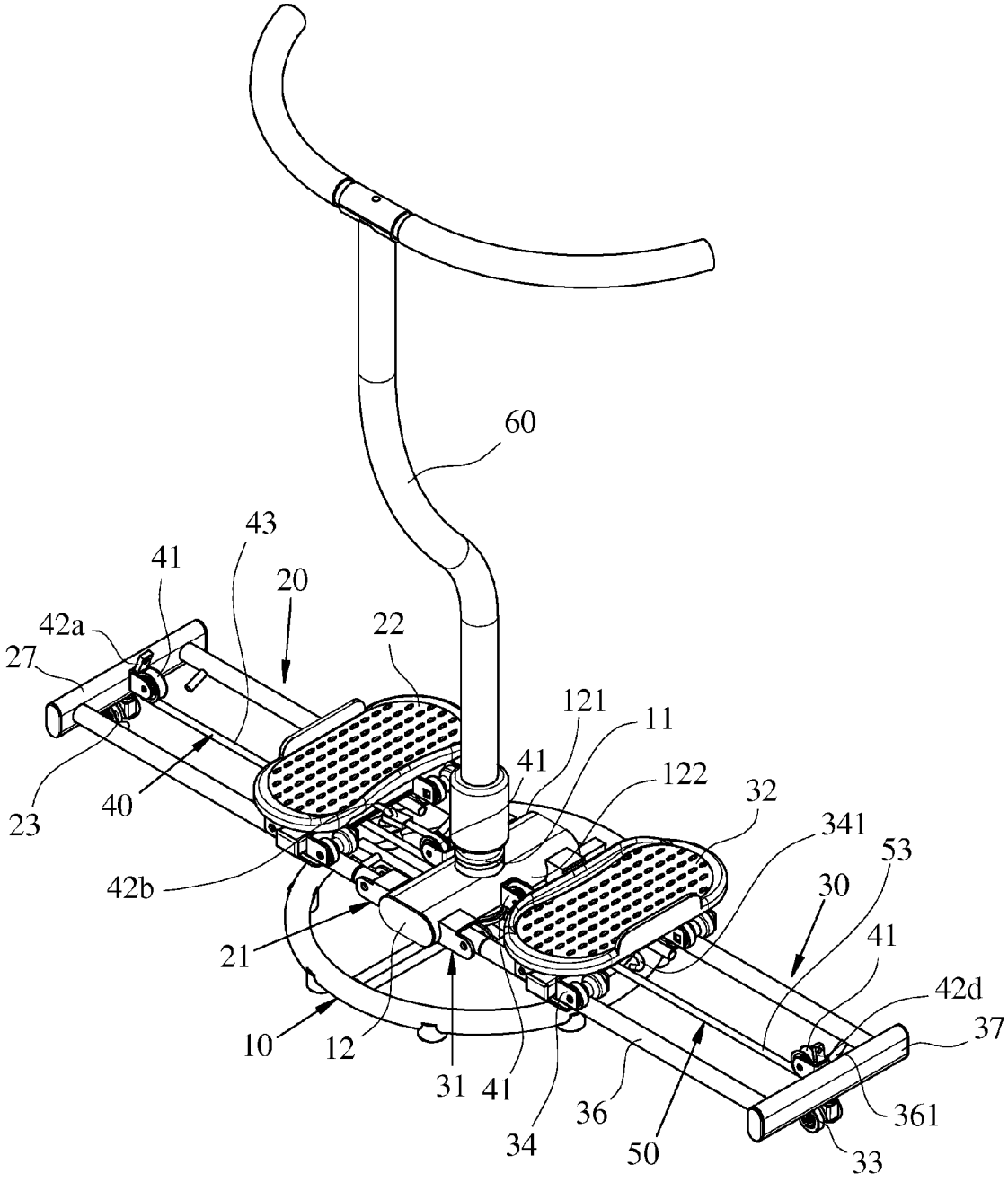
FIG. 1 is a perspective view of a leg exerciser according to the invention with damping assemblies arranged in a first configuration.
Figure 2:
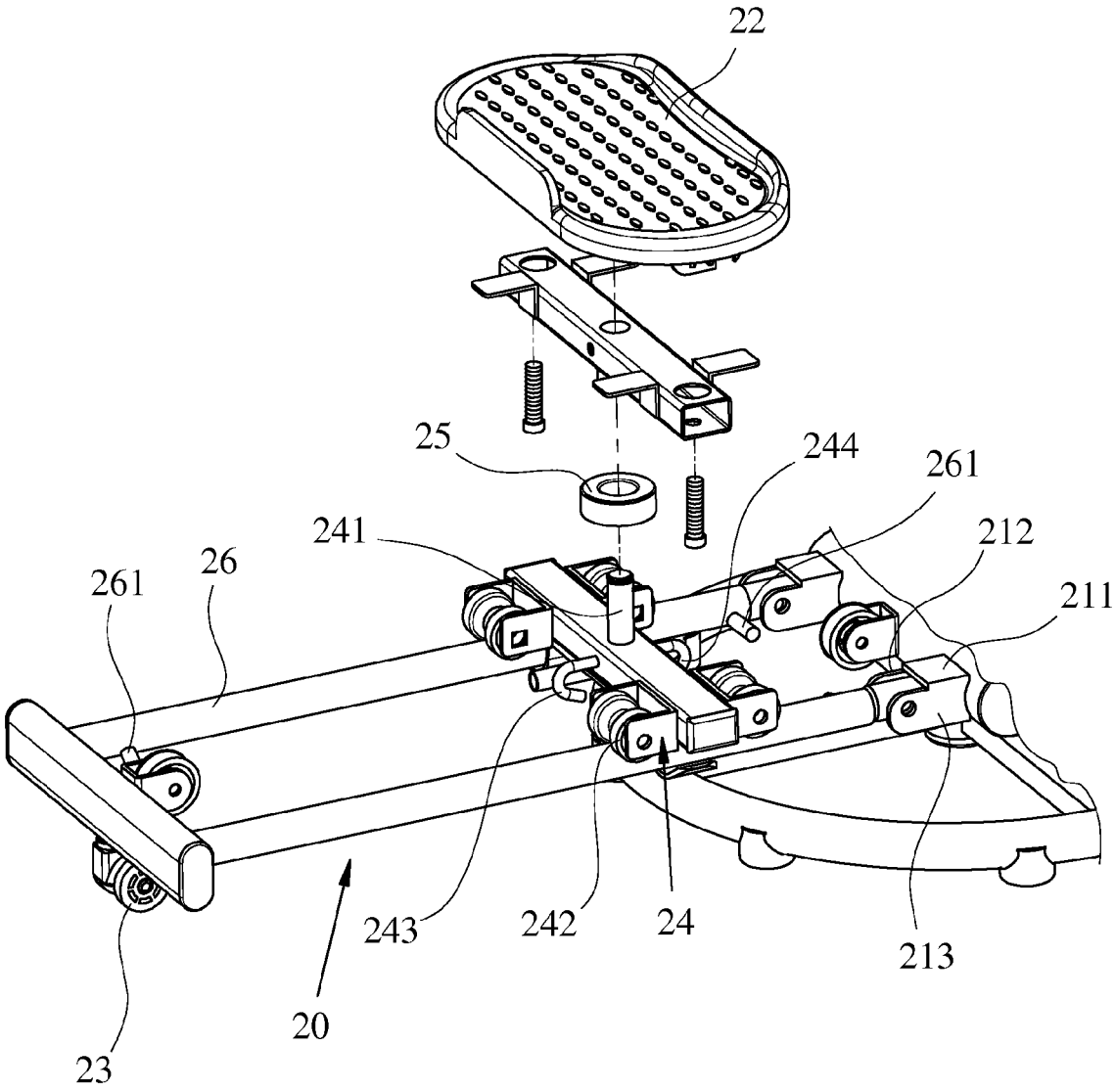
FIG. 2 is an exploded perspective view of the left part of the leg exerciser with the elastic belt removed.

Referring to FIGS. 1 to 6, a leg exerciser in accordance with the invention comprises the following components as discussed in detail below.

A circular base 10 comprises a central seat 12 adapted to rotate horizontally, freely relative to an annular frame (i.e., periphery) of the base 10 (i.e., 360-degree rotation), and a fixed support 11 upwardly extending out of a center of the seat 12. The seat 12 may rotate about the support 11.

A substantially T-shaped handle 60 is provided on the support 11 and extends upward therefrom.

An elongated first carriage assembly 20 comprises two spaced joints 21 secured to one side 121 of the seat 12, the unitary joint 21 including two opposite plates 212, 213 and a top limit plate 211; two parallel rails 26 each having one end pivotably secured to the opposite plates 212, 213 of the joint 21 (i.e., a pivot angle of the rail 26 relative to the joint 21 being limited by the top limit plate 211) and the other end secured to either end of an elongated bar 27, an intermediate portion of the rail 26 being adapted to move along the annular frame of the base 10, the rail 26 including two limit bars 261 each proximate to either end and facing the other rail 26; a caster 23 rotatably mounted on the bottom of an intermediate portion of the bar 27; a wheeling device 24 moveably mounted across the rails 26 and including a top cylindrical rod 241, four grooved wheels 242 arranged at four corners of a virtual rectangle to be adapted to roll along the rails 26, an intermediate first hook 243 facing the bar 27, and an intermediate second hook 244 facing the support 11; a support ring 25 rotatably put on the rod 241; and a first foot plate 22 secured onto the support ring 25 so that the first foot plate 22 may rotate about the rod 241 (i.e., swiveling).

Figure 3:
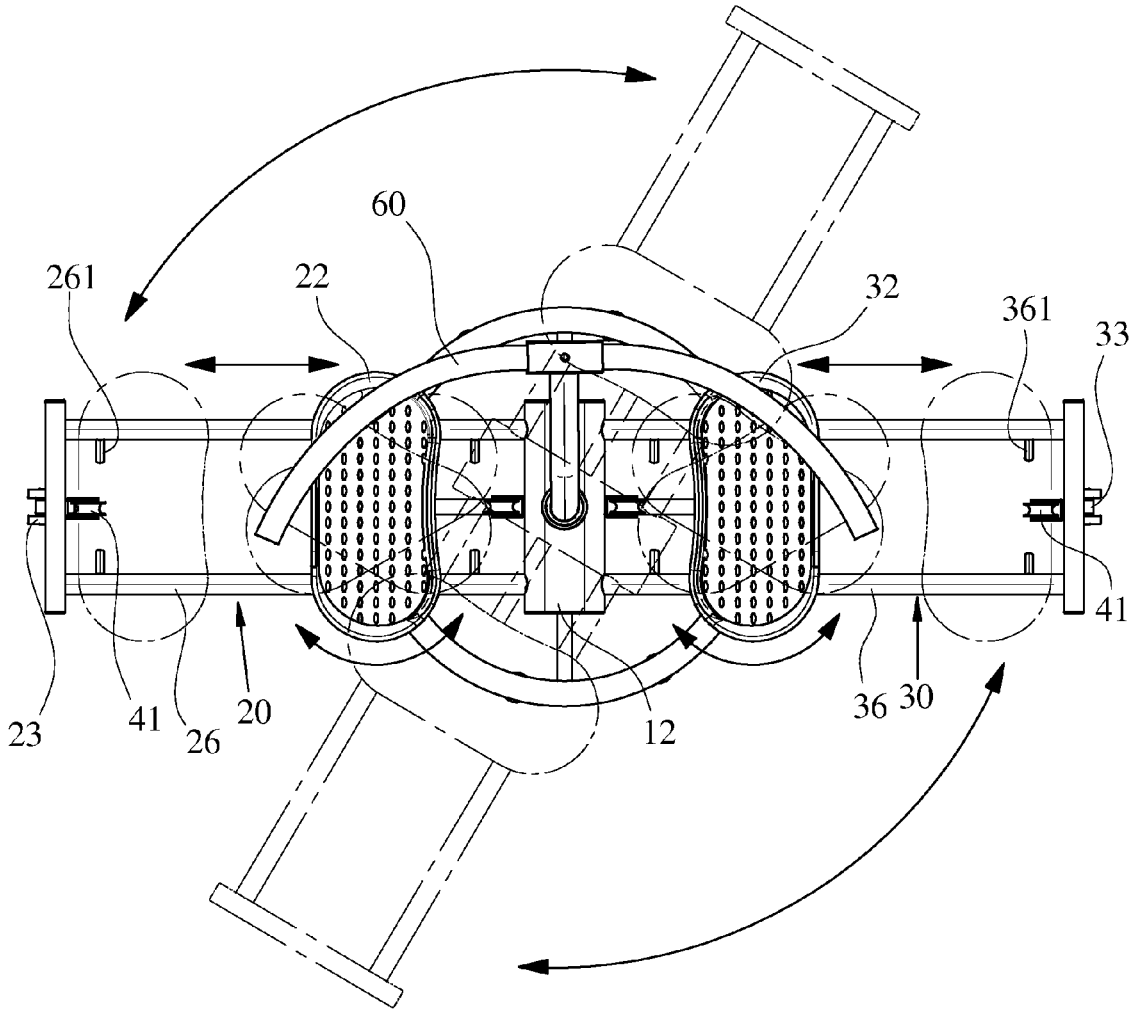
FIG. 3 is top plan view of the leg exerciser showing swivel motion of the foot plates, the lateral motion of the foot plates, and the swivel motion of the carriage assemblies.
Figure 4:
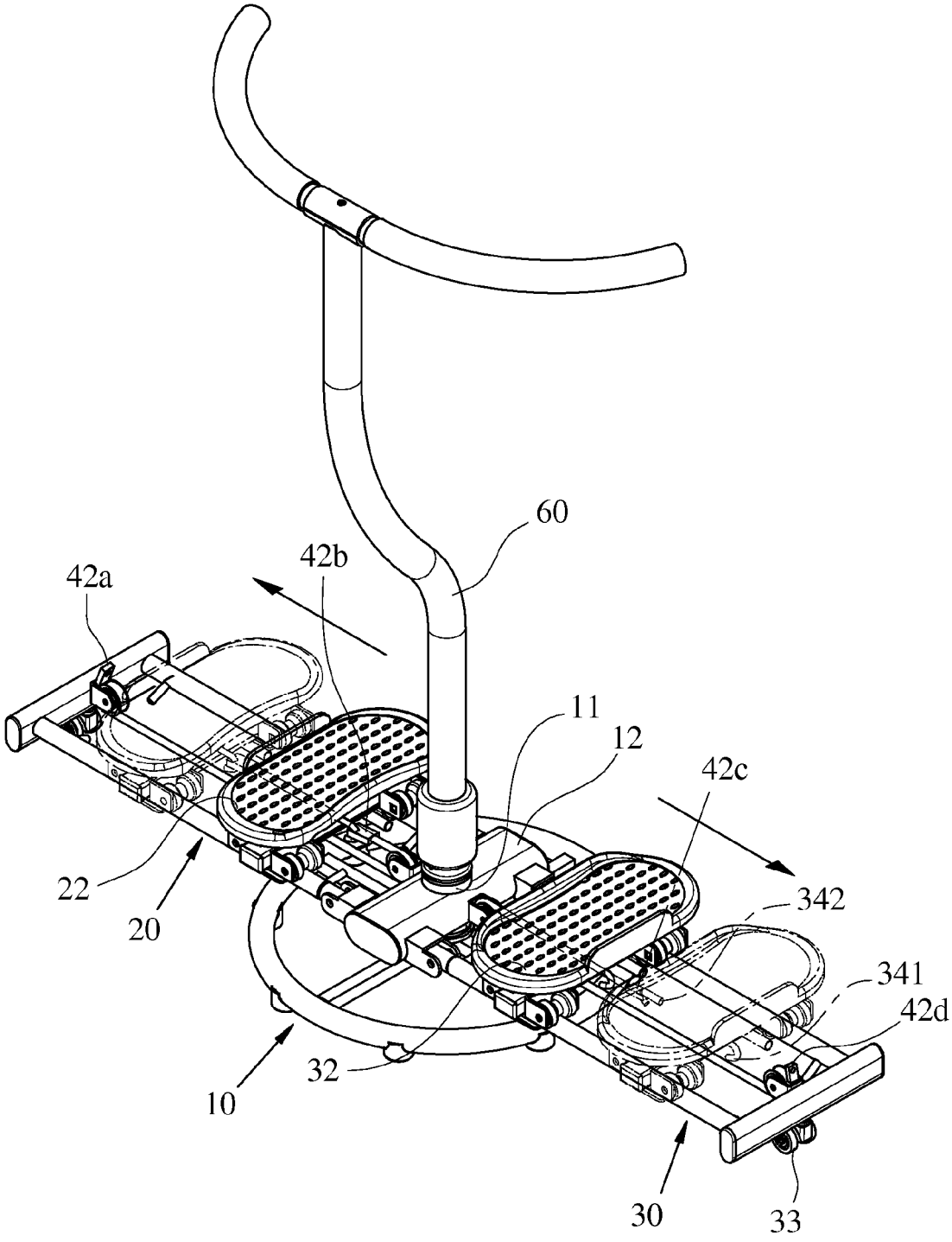
FIG. 4 is a view similar to FIG. 1 showing the outward lateral motion of the foot plates by wheeling on the rails.

A first damping assembly 40 comprises two rollers 41 fixedly secured to one side 121 of the seat 12 between the joints 21 and an intermediate portion of the bar 27 between the other ends of the rails 26 respectively, an elastic belt 43 passing the rollers 41, and two enlarged attachments 42*a*, 42*b* formed at both ends of the belt 43 respectively, the attachment 42*a* having a through hole (not numbered) stopped by the roller 41 on the bar 27 and the attachment 42*b* having a through hole (not numbered) put on the second hook 244 for releasably fastening in a first configuration (see FIGS. 1, 3 and 4).

Likewise, an elongated second carriage assembly 30 comprises two spaced joints 31 secured to the other side 122 of the seat 12, the joint 31 being a mirror image of the joint 21; two parallel rails 36 each having one end pivotably secured to the joint 31 with a pivot angle of the rail 36 relative to the joint 31 being limited and the other end secured to either end of an elongated bar 37, an intermediate portion of the rail 36 being adapted to move along the annular frame of the base 10, the rail 36 including two limit bars 361 each proximate to either end and facing the other rail 36; a caster 33 rotatably mounted on the bottom of an intermediate portion of the bar 37; a wheeling device 34 mounted across the rails 36 and adapted to move therealong, the wheeling device 34 including an intermediate first hook 341 facing the bar 37, and an intermediate second hook 342 facing the support 11; and a second foot plate 32 pivotably mounted on the wheeling device 34 so that the second foot plate 32 may rotate freely relative to the wheeling device 34 (i.e., swiveling).

A second damping assembly 50 comprises two rollers 41 fixedly secured to the other side 122 of the seat 12 between the joints 31 and an intermediate portion of the bar 37 between the other ends of the rails 36 respectively, an elastic belt 53 passing the rollers 41, and two enlarged attachments 42*c*, 42*d* formed at both ends of the belt 53 respectively, the attachment 42*c* having a through hole (not numbered) put on the second hook 342 for releasably fastening in the first configuration and the attachment 42*d* having a through hole (not numbered) stopped by the roller 41 on the bar 37.

Referring to FIGS. 3 and 4 specifically, operations of the invention when the first and second damping assemblies 40, 50 are arranged in a first configuration are detailed below. First, an individual may have the feet firmly standing on the first and second foot plates 22, 32 and the hands grasping the handlebars of the handle 60. Next, the feet of the individual may exert a force to push the first and second foot plates 22, 32 away from each other (i.e., toward the bars 27, 37 respectively) by overcoming the elastic force of the belts 43, 53 and stretching same with the roller 41 on the bar 27 being motionless and the roller 41 on the seat 12 rolling in a first exercise mode. A maximum distance between the first and second foot plates 22, 32 is equal to a distance between the limit bars 261 proximate to the bar 27 and the limit bars 361 proximate to the bar 37. For example, the two limit bars 261 proximate to the bar 27 can prevent the first foot plate 22 from moving out of its desired position. That is, the movement of the first foot plate 22 will be stopped when it contacts the two limit bars 261 proximate to the bar 27. Next, the individual may release the force to cause the stored elastic force of the belts 43, 53 to posh the first and second foot plates 22, 32 toward each other until being stopped by the two limit bars 261 proximate to the seat 12 and the two limit bars 361 proximate to the seat 12 (i.e., returning to its inoperative position). The first exercise mode can exercise inner and outer muscles of legs and stretch legs.

At the same time, in a second exercise mode the individual may rotate the feet to cause both the first foot plate 22 to rotate freely about the cylindrical rod 241 and the second foot plate 32 to rotate freely about the cylindrical rod disposed therebelow. The second exercise mode can exercise the feet.

At the same time, in a third exercise mode, the individual may exert a force onto the first and second foot plates 22, 32 and cause the first and second foot plates 22, 32 and the seat 12 to rotate about the support 11 by moving the wheeling devices 24, 34 along different arcs around the periphery of the base 10. The rotation is done clockwise and counterclockwise in an alternating fashion. The third exercise mode can exercise the lumbar zones of the individual.

Alternatively, the first and second damping assemblies 40, 50 can be arranged in a second configuration. In detail, as shown in FIG. 5 in conjunction with FIGS. 1 and 2, the attachment 42*a* has its through hole put on the first hook 243 for releasably fastening, the attachment 42*b* is stopped by the roller 41 on the seat 12, the attachment 42*c* is stopped by the roller 41 on the seat 12, and the attachment 42*d* has its through hole put on the first hook 341 for releasably fastening.

Figure 5:
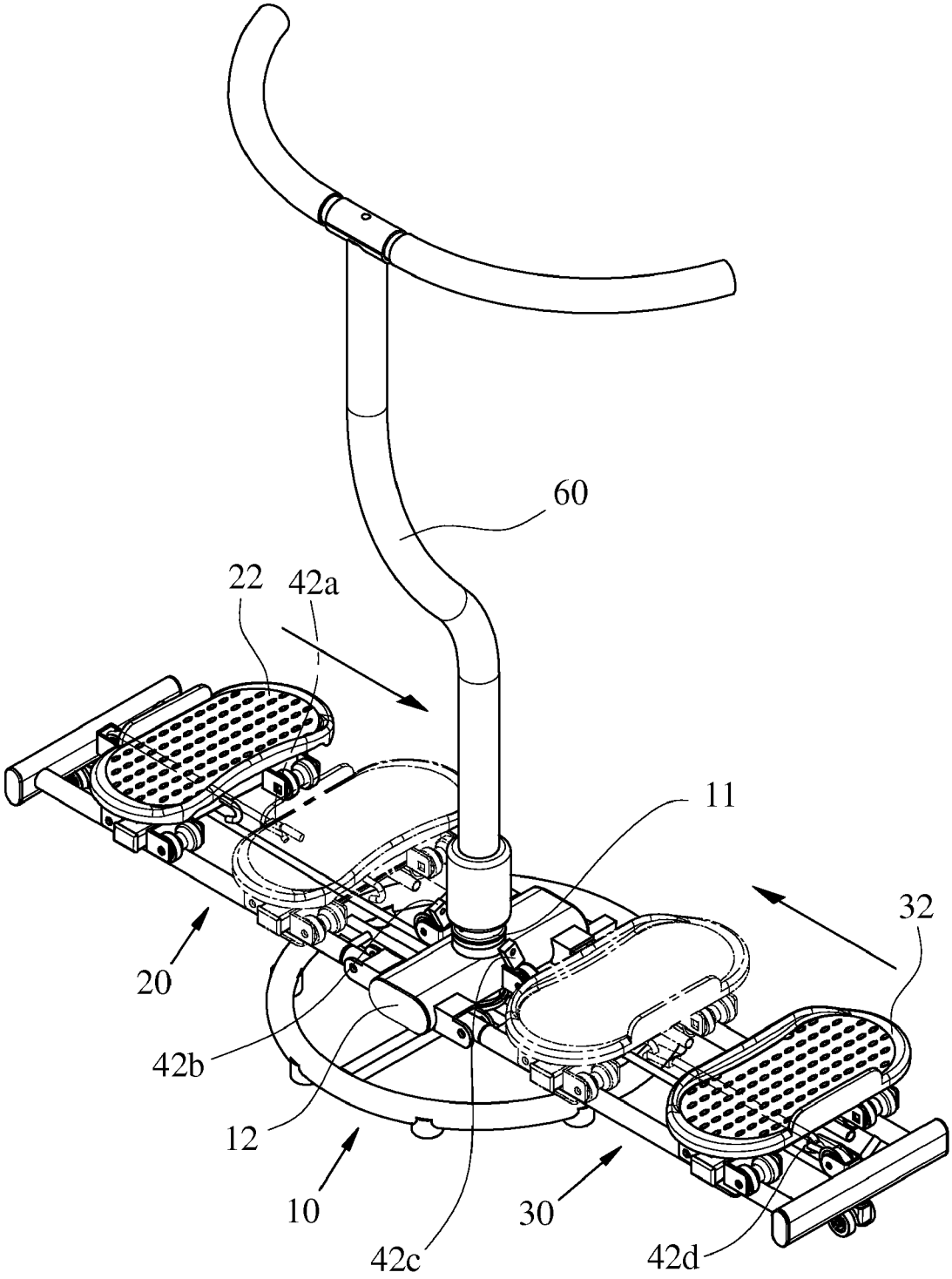
FIG. 5 is a view similar to FIG. 1 showing the damping assemblies arranged in a second configuration and the inward lateral motion of the foot plates by wheeling on the rails.
Figure 6:
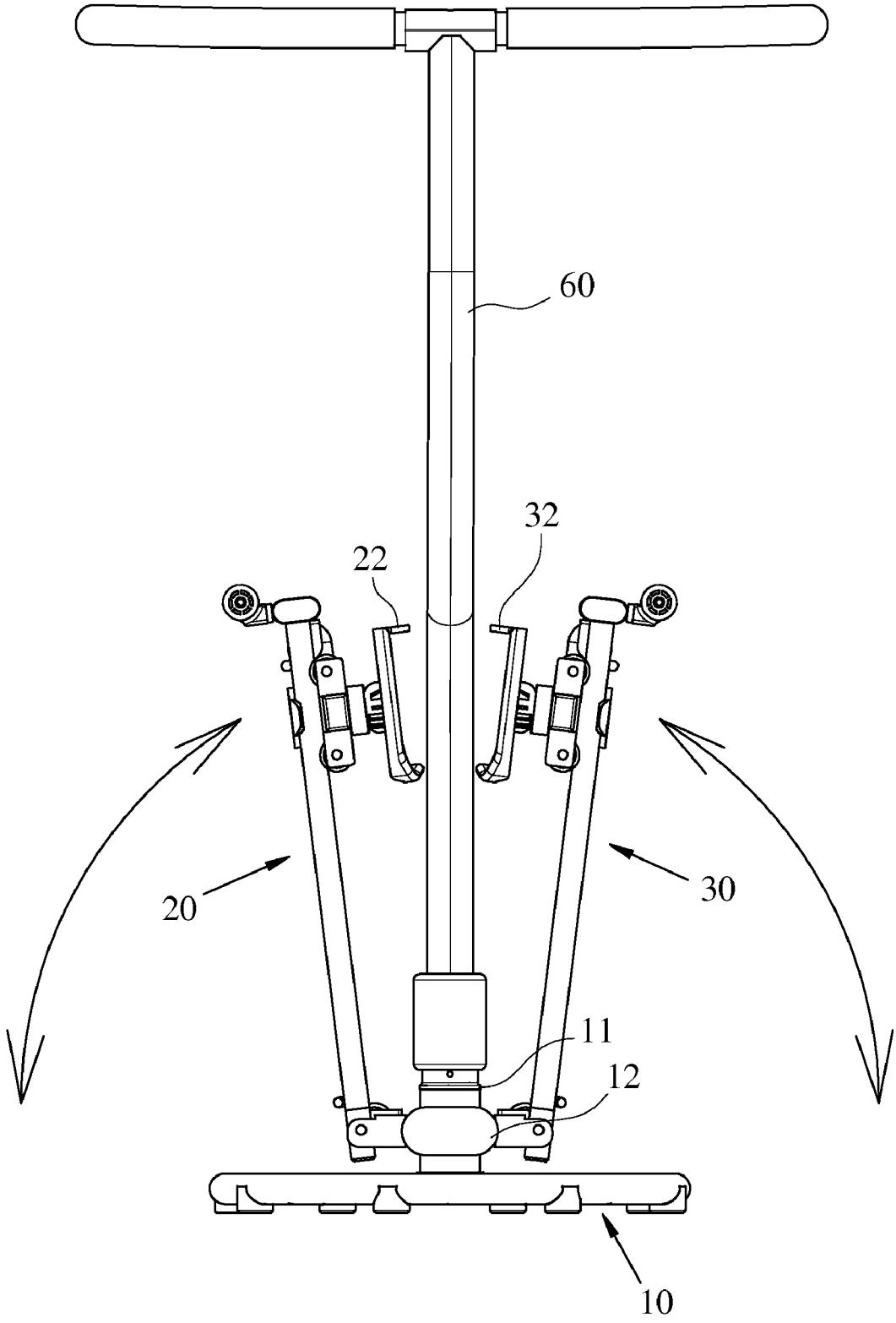
FIG. 6 is a front view showing the leg exerciser with the damping assemblies arranged in a second configuration in an inoperative position by folding the carriage assemblies upward toward the handle by pivoting and in a ready to use position by extending the carriage assemblies downward away from the handle by pivoting.

As shown in FIG. 5 specifically, operations of the invention when the first and second damping assemblies 40, 50 are arranged in the second configuration are detailed below. First, an individual may have the feet firmly standing on the first and second foot plates 22, 32 and the hands grasping the handlebars of the handle 60. Next, the feet of the individual may exert a force to push the first and second foot plates 22, 32 toward each other (i.e., away from the bars 27, 37 respectively) by overcoming the elastic force of the belts 43, 53 and stretching same with the roller 41 on the bar 27 rolling and the roller 41 on the seat 12 being motionless in the first exercise mode. Next, the individual may release the force to cause the stored elastic force of the belts 43, 53 to push the first and second foot plates 22, 32 away from each other until being stopped by the two limit bars 261 proximate to the bar 27 and the two limit bars 361 proximate to the bar 37 (i.e., returning to its inoperative position). The first exercise mode can exercise inner and outer muscles of legs and stretch legs. At the same time, both the second and third exercise modes are performed Referring to FIG. 6 specifically, after using the exerciser, for storage, or for transportation, an individual may fold the first and second carriage assemblies 20, 30 upward toward the handle 60 by pivoting (as indicated by two upward arrows). Of course, the individual may extend the first and second carriage assemblies 20, 30 downward away from the handle 60 by pivoting prior to use (as indicated by two downward arrows).

While the invention has been described in terms of preferred embodiments, those skilled in the art will recognize that the invention can be practiced with modifications within the spirit and scope of the appended claims.

What is claimed is:

1. An exercise device comprising:

a base comprising a rotatable central seat and a fixed support upwardly extending out of the seat wherein the seat is adapted to rotate about the support;

first and second carriage assemblies each comprising two opposite rails each having one end formed as a joint pivotably secured to either side of the seat so that each of the first and second carriage assemblies is adapted to either pivot upward about the seat to dispose in a folded position or pivot downward about the seat to dispose in a horizontal ready to use position, a bar disposed across the other ends of the rails, and a foot plate adapted to rotate horizontally with respect to the rails and move along the rails;

first damping assembly disposed in the first carriage assembly and comprising two first rollers wherein one first roller is fixedly secured to the seat between the joints of the first carriage assembly and the other first roller is fixedly secured to an intermediate portion of the bar of the first carriage assembly respectively, a first elastic belt passing the first rollers, and two first attachments formed at both ends of the first elastic belt respectively, the first attachments being releasably fastened at the first carriage assembly; and second damping assembly disposed in the second carriage assembly and comprising two second rollers fixedly secured to the seat between the joints of the second carriage assembly and an intermediate portion of the bar of the second carriage assembly respectively, a second elastic belt passing the first rollers, and two second attachments formed at both ends of the second elastic belt respectively, the second attachments being releasably fastened at the second carriage assembly, wherein in a first configuration one first attachment is stopped by one first roller on the bar of the first carriage assembly, the other first attachment is releasably secured to the foot plate of the first carriage assembly, one second attachment is stopped by one second roller on the bar of the second carriage assembly, and the other second attachment is releasably secured to the foot plate of the second carriage assembly; and wherein in a second configuration one first attachment is releasably secured to the foot plate of the first carriage assembly, the other first attachment is stopped by the other first roller on the seat, one second attachment is releasably secured to the foot plate of the second carriage assembly, and the other second attachment is stopped by the other second roller on the seat.

2. The exercise device of claim 1, wherein each joint comprises two opposite plates pivotably secured to the rail, and a top limit plate integrally formed with the opposite plates, wherein a pivot angle of the rail relative to the joint thereof is limited by the top limit plate, and wherein each of the first and second carriage assemblies further comprises a caster rotatably mounted on bottom of the bar thereof.

3. The exercise device of claim 2, wherein the base is circular, and further comprising a substantially T-shaped handle disposed on the support and extending upward therefrom.

4. The exercise device of claim 3, wherein each of the first and second carriage assemblies further comprises a wheeling device moveably mounted across the rails, the wheeling device including a top cylindrical rod, a plurality of wheels adapted to roll along the rails, and a support ring mounted under the foot plate and rotatably put on the top cylindrical rod.

5. The exercise device of claim 4, wherein each rail comprises two limit bars each proximate to either end and facing either damping assembly, and wherein each of the first and second carriage assemblies is adapted to travel between the limit bars of each rail.

* * * * *